US009226873B2

(12) United States Patent
Chen

(10) Patent No.: US 9,226,873 B2
(45) Date of Patent: Jan. 5, 2016

(54) STEAM PHYSIOTHERAPY APPARATUS

(71) Applicants: Hung-Lieh Chen, Taipei (TW); Ping Ping Lin, Sugar Land, TX (US)

(72) Inventor: Hung-Lieh Chen, Taipei (TW)

(73) Assignees: Hung-Lieh Chen, Taipei (TW); Ping Ping Lin, Sugar Land, TX (US)

( * ) Notice: Subject to any disclaimer, the term of this patent is extended or adjusted under 35 U.S.C. 154(b) by 528 days.

(21) Appl. No.: 13/734,037

(22) Filed: Jan. 4, 2013

(65) Prior Publication Data

US 2014/0194797 A1 Jul. 10, 2014

(51) Int. Cl.

| | |
|---|---|
| ***A61H 33/02*** | (2006.01) |
| ***A61H 33/06*** | (2006.01) |
| *A61H 33/14* | (2006.01) |
| *A61H 35/00* | (2006.01) |

(52) U.S. Cl.

CPC ..... *A61H 33/066* (2013.01); *A61H 2033/068* (2013.01); *A61H 2033/141* (2013.01); *A61H 2035/004* (2013.01); *A61H 2203/0431* (2013.01)

(58) Field of Classification Search

CPC ..... A61H 33/06; A61H 2033/061; A61H 33/065; A61H 33/066; A61H 33/067; A61H 2033/068; A61H 33/10; A61H 2035/004; A61H 33/12; A61H 2201/02; A61H 2201/0207; A61H 2201/0221; A61H 2201/025; A61H 2201/0257; A61H 2203/0431; A61H 2203/0425

USPC ..... 601/15, 16, 154, 155, 156, 158, 160; 4/524–534; 604/23; 607/80–84, 87, 96, 607/98, 99, 104, 108–111

See application file for complete search history.

(56) References Cited

U.S. PATENT DOCUMENTS

| | | | | | |
|---|---|---|---|---|---|
| 871,074 | A * | 11/1907 | Stockton | 601/11 |
| 2,814,297 | A * | 11/1957 | Stewart | 607/87 |
| 3,092,843 | A * | 6/1963 | Wright | 4/527 |
| 4,031,573 | A * | 6/1977 | Romanoff | 4/532 |
| 4,105,036 | A * | 8/1978 | McGrath | 607/83 |
| 4,277,855 | A * | 7/1981 | Poss | 4/524 |
| 4,425,672 | A * | 1/1984 | Johnson et al. | 4/596 |
| 5,794,290 | A * | 8/1998 | Roberts | 8/159 |
| 6,339,854 | B1 * | 1/2002 | Amendt | 4/524 |
| 6,615,419 | B1 * | 9/2003 | Chang | 4/524 |
| 2006/0260037 | A1 * | 11/2006 | Chen | 4/524 |
| 2013/0042402 | A1 * | 2/2013 | Parker | 4/524 |

* cited by examiner

*Primary Examiner* — Steven Douglas
(74) *Attorney, Agent, or Firm* — WPAT, PC; Justin King

(57) ABSTRACT

A steam physiotherapy apparatus includes an open-topped physiotherapy chamber having a door, a steam generating unit, and a steam pipe for conveying generated steam into the physiotherapy chamber. Tourmaline tiles are attached to an inner surface of the physiotherapy chamber, a steam inlet pipe is provided on a bottom of the physiotherapy chamber to communicate with the steam pipe, and a steam flow guide plate is placed on the steam inlet pipe. The steam inlet pipe has two diametrically opposite steam outlets directed to two opposite directions, such that the steam flowing out of the two steam outlets forms a swirl that moves upward along the inner surface of the physiotherapy chamber to heat the tourmaline tiles. The heated tourmaline tiles release far infrared rays and negative ions that help reducing reactive oxygen species and free radicals in the user's body and help the user to give off deep-layer sweat.

8 Claims, 4 Drawing Sheets

STEAM PHYSIOTHERAPY APPARATUS

FIELD OF THE INVENTION

The present invention relates to a steam physiotherapy apparatus internally provided with tourmaline tiles that release far infrared rays and negative ions when being heated by steam conveyed into the apparatus, and the released far infrared rays and negative ions can penetrate the body of a user sitting in the apparatus to help removal of toxins from the user's body via capillaries and sweat glands.

BACKGROUND OF THE INVENTION

In the modern society, people tend to have thickened and hardened blood vessel walls and accordingly suffer from cardiovascular disease because they usually intake too much high protein and cholesterol in their diets and lack of exercises. The blood vessel walls would also become thicker and hardened to cause cardiovascular disease when a person is getting old and has slowed metabolism. Moreover, some diseases having connection with metabolism and blood circulation, such as acute myocardial infarction and stroke, also have relation to hardened blood vessels.

The currently available medical technology can not thin or soften the thickened and hardened blood vessel walls. However, taking proper exercises is one of the ways to improve the cardiovascular disease. A man, when taking strenuous exercises, will have increased heartbeat higher than 120 and sweat heavily due to compressed muscles. At this point, toxins in the body, such as lipid peroxide in the blood vessel walls, will be discharged from the body via capillaries and sweat glands along with sweat. The removal of toxins from a man's body is health-beneficial to the gradual softening of blood vessel walls again. However, the strenuous exercises are not suitable for the aged and some disabled who are not able to conveniently move alone. Under this condition, the aged and the disabled tend to become weaker and weaker because the toxins in their bodies could not be duly discharged along with sweat. For people to sweat heavily even if they do not take exercises, steam bath has been introduced into people's daily life.

While the heat energy from the steam bath could forcefully compress and permeate a man's skin, it can only reach at the striae and the interstitial space in skin. The sweat given off the body under this condition is normally referred to as "surface-layer sweat" or "cold sweat". U.S. Pat. No. 3,092,843 discloses a portable steam chest for steam bath, with which a user can give off the surface-layer sweat due to the steam heat.

U.S. Pat. No. 6,327,720 discloses a sauna made with illite surfaces, which is also a device for steam bath and uses illite to release far infrared rays, so that heat can more easily penetrate into the user's body to promote blood circulation.

The main functions that can be achieved with the steam bath provided by the portable steam chest disclosed in U.S. Pat. No. 3,092,843 include cleaning pores on skin and giving off sweat. On the other hand, the functions that can be achieved with the steam bath provided by the sauna made with illite surfaces disclosed in U.S. Pat. No. 6,327,720 include not only the cleaning pores and sweating, but also permeation of far infrared rays into skin to produce a health-beneficial hyperthermia effect.

SUMMARY OF THE INVENTION

A primary object of the present invention is to provide a steam physiotherapy apparatus, which is able to release far infrared rays and negative ions when an amount of steam having a temperature ranged between 40 and 45° C. is conveyed into the steam physiotherapy apparatus, and the released far infrared rays and negative ions can deeply penetrate the skin of a user sit in the steam physiotherapy apparatus to reduce lipid peroxide and free radical in the user's body to create health benefits to the user.

Another object of the present invention is to provide a steam physiotherapy apparatus, which is able to release far infrared rays and negative ions when being heated by steam conveyed thereinto, and the released negative ions can expand in deep body tissues of a user sit in the steam physiotherapy apparatus to compress the user's body fluid, so that toxins and wastes clogging the user's blood vessels are discharged out of the user's body from capillaries to the skin via sweat glands. And, the sweat excreted in this manner is referred to as deep-layer sweat.

To achieve the above and other objects, the steam physiotherapy apparatus according to the present invention includes a substantially cylindrical physiotherapy chamber for a user to sit therein and having an open top, a steam generating unit for generating steam, and a steam pipe for conveying the generated steam into the physiotherapy chamber. A plurality of tourmaline tiles is densely and uniformly distributed on the inner surface of the physiotherapy chamber, a steam inlet pipe is provided in the physiotherapy chamber on a bottom thereof to communicate with the steam pipe, and a steam flow guide plate is placed on a top of the steam inlet pipe with an annular space left between the steam flow guide plate and the inner surface of the physiotherapy chamber. The steam inlet pipe has two steam outlets horizontally extended to two diametrically opposite points near an inner bottom edge of the physiotherapy chamber to direct to two opposite directions, such that the steam flowing out of the two steam outlets forms a swirl that passes through the annular space and moves upward along the inner surface of the physiotherapy chamber to thereby heat the tourmaline tiles. The heated tourmaline tiles release far infrared rays and negative ions that can deeply penetrate the user's skin to reduce reactive oxygen species and free radicals in the user's body and help the user to give off deep-layer sweat.

The tourmaline tiles contain a type of natural pyroelectric mineral powder, which, when being heated, will release negative ions and far infrared rays.

The physiotherapy chamber has a door operably closing an entrance thereof, and further includes a top cover removably closing the open top thereof. The top cover has a sideward opening, via which the user's head can upward extend to expose to an outer side of the physiotherapy chamber.

In a preferred embodiment, the physiotherapy chamber is manufactured into an upper body portion and a lower body portion. A hoop is tightened around a joint between the upper and the lower body portion to simultaneously cover a lower edge of the upper body portion and an upper edge of the lower body portion, so as to prevent the upper and the lower body portion from moving laterally relative to each other.

The physiotherapy chamber has a peripheral wall, which defines a variable inner diameter gradually increasing from bottom to top, and the inner diameter at the open top of the physiotherapy chamber is reduced again to form a narrowed neck portion on the physiotherapy chamber.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and with reference to the accompanying drawings.

Figure 1:
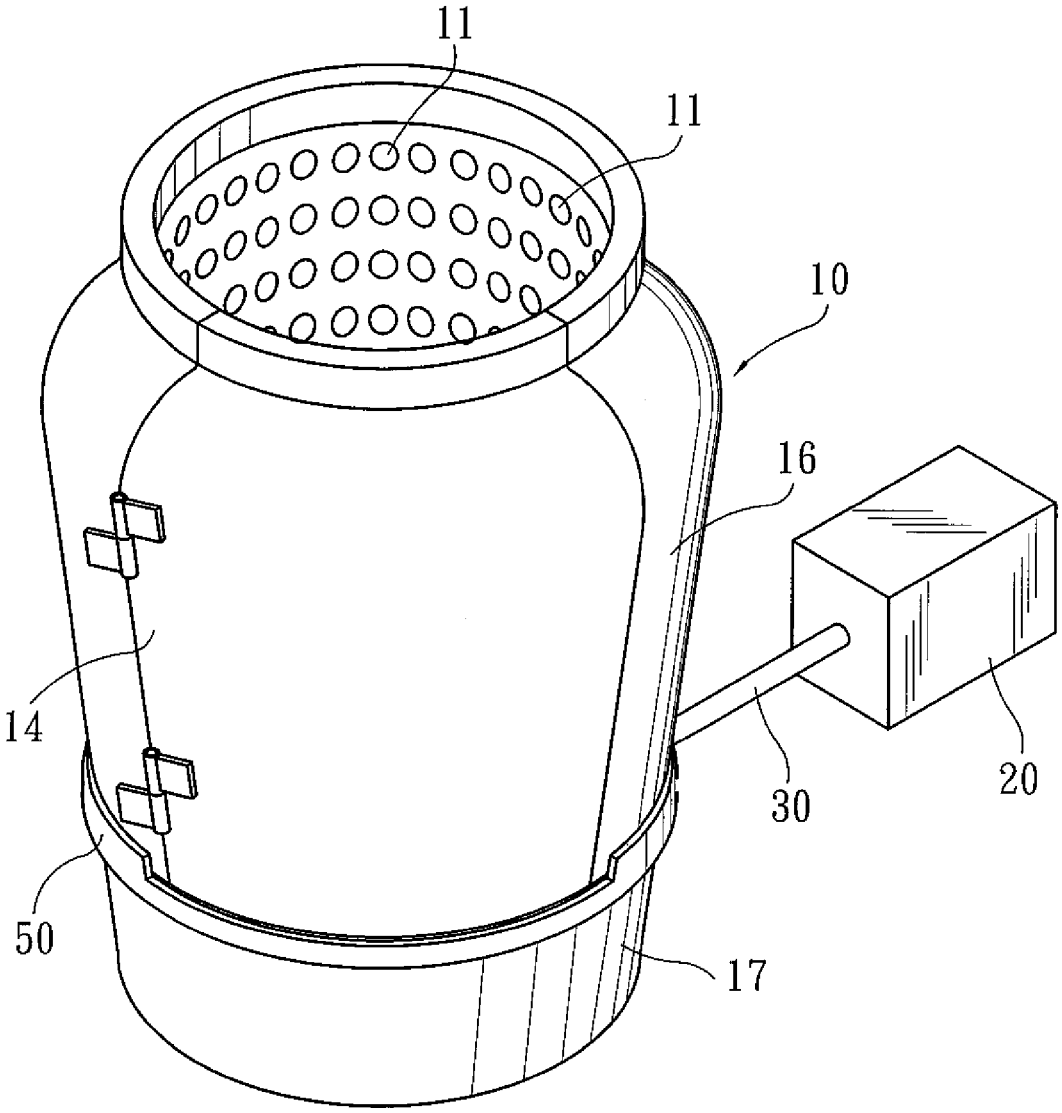
FIG. 1 is an assembled perspective view of a steam physiotherapy apparatus according to a preferred embodiment of the present invention.
Figure 2:
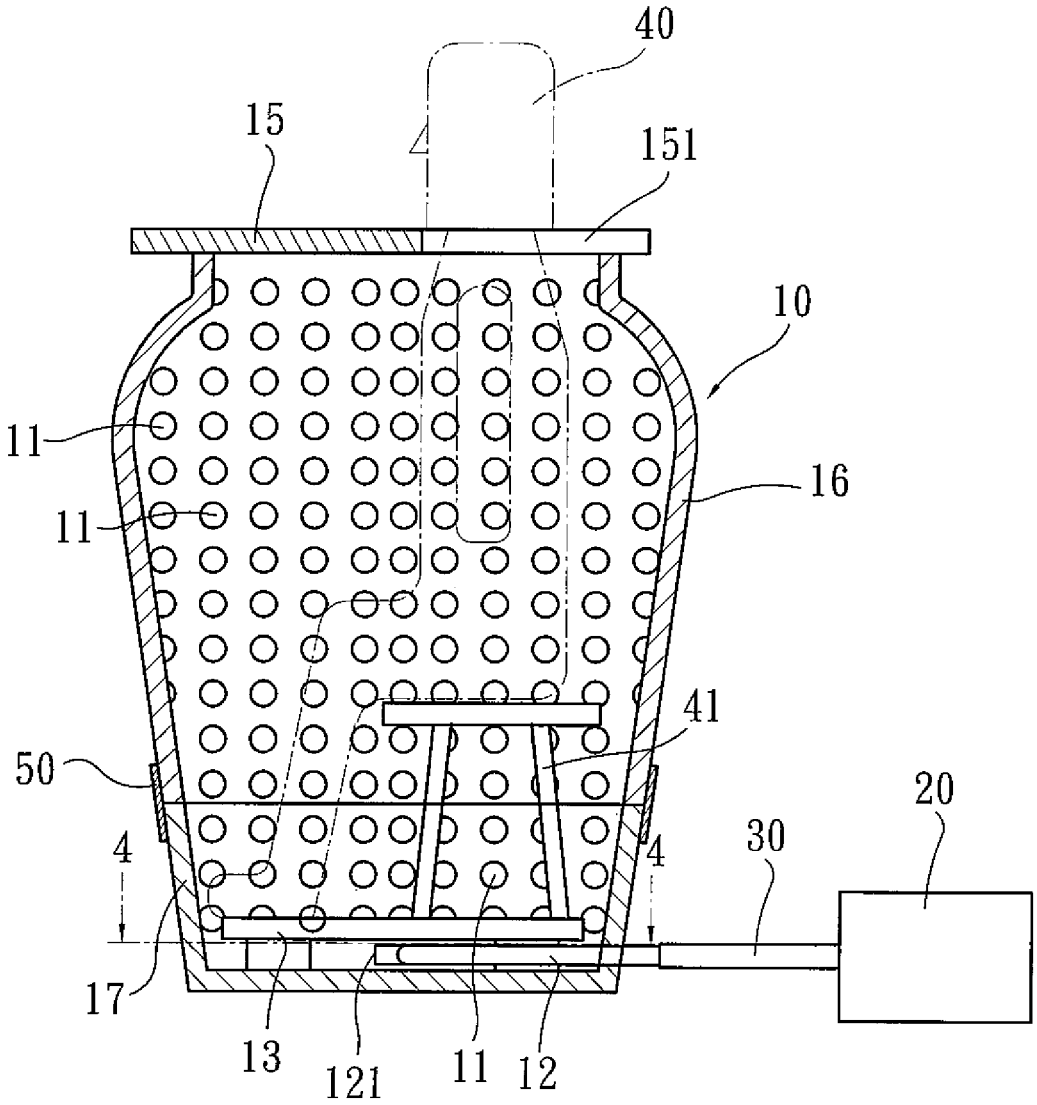
FIG. 2 is a longitudinal sectional view of FIG. 1.
Figure 3:
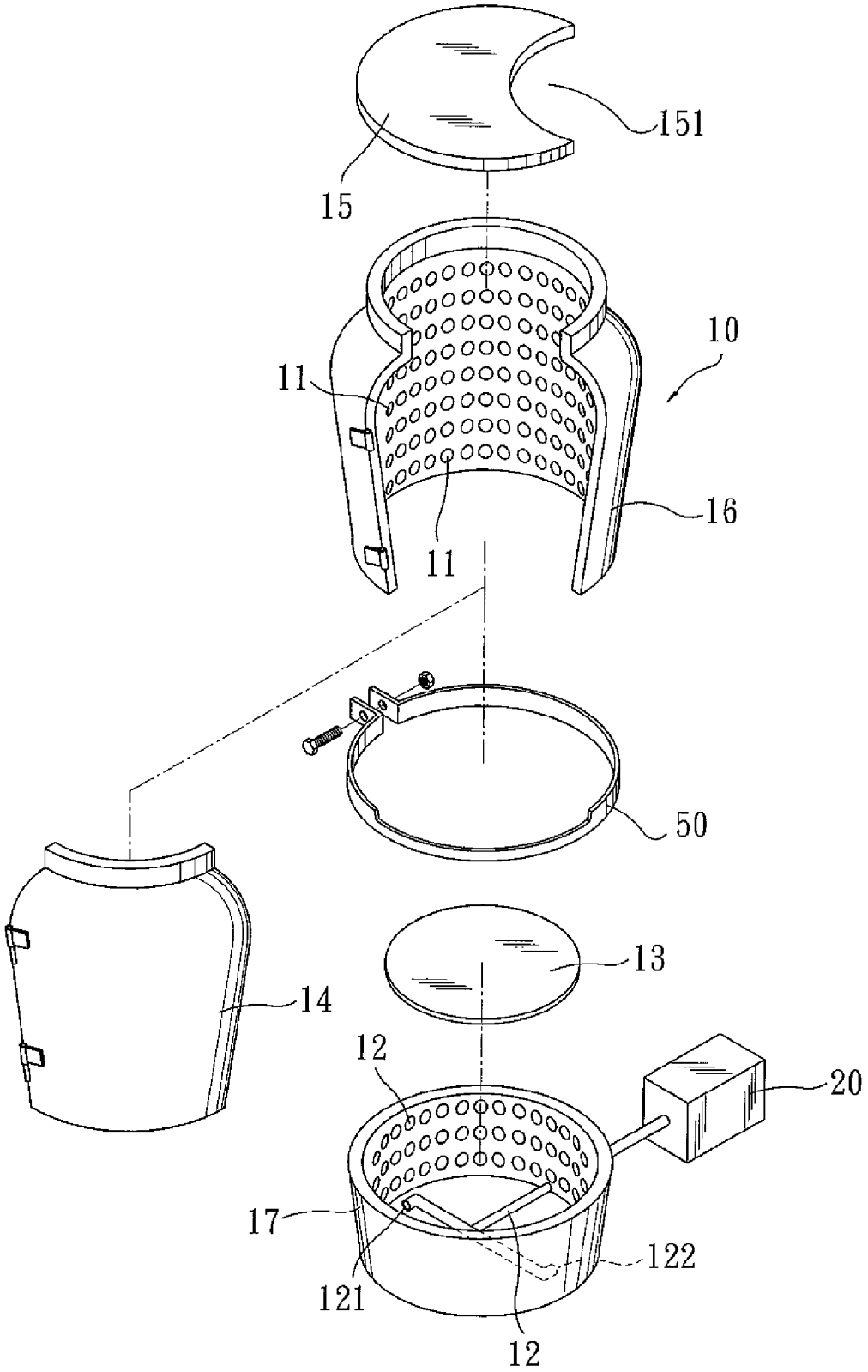
FIG. 3 is an exploded view of FIG. 1.

Please refer to FIGS. 1 and 3 that are assembled and exploded perspective views, respectively, of a steam physiotherapy apparatus according to a preferred embodiment of the present invention, and to FIG. 2 that is a longitudinal sectional view of FIG. 1 with a top cover attached thereto.

The steam physiotherapy apparatus according to the present invention employs the principle of energy medicine to achieve the purpose of repairing damaged tissue cells.

As can be seen in FIGS. 1, 2 and 3, the steam physiotherapy apparatus of the present invention includes a physiotherapy chamber 10, a steam generating unit 20 for generating steam, and a steam pipe 30 for conveying the generated steam into the physiotherapy chamber 10. The physiotherapy chamber 10 allows a user 40 to sit therein and expose to the energy of far infrared rays and negative ions that provides physiotherapeutic effect. Preferably, the steam conveyed into the physiotherapy chamber 10 has a temperature ranged between 40 and 45° C.

Figure 4:
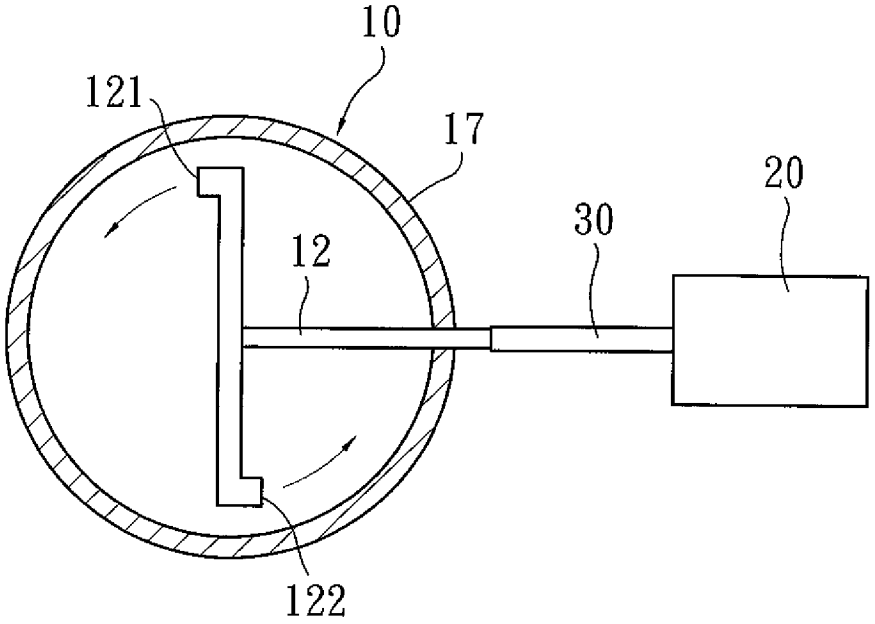
FIG. 4 is a cross sectional view taken along line 4-4 of FIG. 2.

The physiotherapy chamber 10 is substantially cylindrical in shape and has an open top. A plurality of tourmaline tiles 11 is provided on an inner surface of the physiotherapy chamber 10. The tourmaline tiles 11 release far infrared rays and negative ions when they are heated. In the present invention, the tourmaline tiles 11 are densely and uniformly distributed on the inner surface of the physiotherapy chamber 10. A steam inlet pipe 12 is provided in the physiotherapy chamber 10 on a bottom thereof to communicate with the steam pipe 30, and a steam flow guide plate 13 is placed on a top of the steam inlet pipe 12 with an annular space left between the steam flow guide plate 13 and the inner surface of the physiotherapy chamber 10. Please also refer to FIG. 4, which is a cross sectional view taken along line 4-4 of FIG. 2. The steam inlet pipe 12 has two steam outlets 121, 122 that are horizontally extended to two diametrically opposite points close to the inner surface of the physiotherapy chamber 10 around the bottom thereof. The two steam outlets 121, 122 have open terminal ends directed to two opposite directions, such that the steam flowing out of the two steam outlets 121, 122 forms a swirl that overflows the steam flow guide plate 13 via the annular space left between the steam flow guide plate 13 and the inner surface of the physiotherapy chamber 10 and moves upward along the inner surface of the physiotherapy chamber 10 to thereby heat the tourmaline tiles 11 provided on the inner surface of the physiotherapy chamber 10. As having been mentioned above, the heated tourmaline tiles 11 will release far infrared rays and negative ions. In the present invention, the steam flowing out of the two steam outlets 121, 122 of the steam inlet pipe 12 swirls counterclockwise.

Far infrared energy has the ability to permeate a man's skin by more than 5 cm deep to improve blood circulation. With the help of the deep penetration ability of the far infrared rays into human body, negative ions can be more easily absorbed by human body to neutralize reactive oxygen species and free radicals. The negative ions expand in our body to compress the body fluid therein, so that toxins in deep tissues along with the body fluid are discharged from our body via capillaries and sweat glands. The sweat given off in this manner is herein referred to as the deep-layer sweat. Therefore, the negative ions deeply penetrating into our body can reduce the lipid peroxides and repair cells. Toxins discharged along with the deep-layer sweat include various wastes that clog the blood vessels and lymphatic vessels. After the clogs are removed therefrom, the blood and lymphatic vessels naturally gradually become soft again to ensure normal blood circulation and healthy body condition.

The tourmaline tiles 11 contain the powder of a type of natural pyroelectric mineral, which, when being heated, will release negative ions and far infrared rays. In the present invention, this type of natural pyroelectric mineral comes from the Dekiyama Kouzan in Aichi Ken of Japan, and an average potential of the negative ions released therefrom is about −29.7 mV. The tourmaline tiles 11 are produced by mixing the powder of this pyroelectric mineral with pottery clay, extruding the mixture into a sheet, and then drying the sheet in a kiln.

To allow the user 40 to conveniently enter and go out it, the physiotherapy chamber 10 has an entrance operably closed by a door 14. A chair 41 is provided in the physiotherapy chamber 10 for the user to sit thereon. The physiotherapy chamber 10 further includes a top cover 15 for removably covering the open top thereof. The top cover 15 has a sideward opening 151, so that the user can sit on the chair 41 in the physiotherapy chamber 10 with his or her head upward extending through the opening 151 to locate outside the physiotherapy chamber 10 in a room temperature environment without being affected by the steam that has a high temperature between 40 and 45° C.

The physiotherapy chamber 10 can be made of pottery clay and the tourmaline tiles 11 can be fixedly attached to the inner surface of the physiotherapy chamber 10 with cement. The pottery-clay-made physiotherapy chamber 10 is quite heavy and has a large volume, and is therefore uneasy to transport. To overcome this problem, the physiotherapy chamber 10 according to the present invention is manufactured into an upper body portion 16 and a lower body portion 17 that can be transported separately. The door 14 is pivotally connected to the upper body portion 16. The upper body portion 16 and the lower body portion 17 can be firmly connected together with a hoop 50, which is tightened around a joint between the upper and the lower body portion 16, 17 to simultaneously cover a lower edge of the upper body portion 16 and an upper edge of the lower body portion 17, so as to effectively prevent the upper and the lower body portion 16, 17 from moving laterally relative to each other. Alternatively, a type of highly adhesive clay can be applied along the joint between the assembled upper and lower body portion 16, 17 to hold them in place.

The physiotherapy chamber 10 has a peripheral wall, which defines a variable inner diameter gradually increasing from bottom to top. With this configuration, it is able to reduce the reaction force exerted by the inner surface of the physiotherapy chamber 10 on the steam, allowing the swirling steam to more smoothly flow upward while expanding its diameter. However, the diameter at the open top of the physiotherapy chamber 10 is reduced again to form a narrowed neck portion on the physiotherapy chamber 10. Therefore, when the user 40 sits in the physiotherapy chamber 10 with his or her neck resting on a rim of the open top of the physiotherapy chamber 10, the user's body would not contact with the peripheral wall of the physiotherapy chamber 10 and accordingly, would not interfere with the movement of the swirling steam.

In summary, the swirling steam in the physiotherapy chamber 10 is able to heat all the tourmaline tiles 11 for the latter to release far infrared rays and negative ions. The negative ions released from the tourmaline tiles 11 can deeply penetrate into the user's body to achieve various therapeutic effects, including repairing damaged tissue cells, removing toxins from the body, and particularly, discharging vessel-clogging wastes out of the user's body along with the deep-layer sweat, so that the blood vessels can gradually become soft again to reduce the occurrence of cardiovascular disease and ensure the normal operation of visceral organs.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A steam physiotherapy apparatus, comprising:

a physiotherapy chamber for a user to sit therein, having a plurality of tourmaline tiles;

a steam generating unit for generating steam; and a steam pipe for conveying the steam into the physiotherapy chamber;

wherein the physiotherapy chamber is substantially cylindrical in shape and has an open top and a door operably closing an entrance thereof, the tourmaline tiles are densely and uniformly distributed on an inner surface of the physiotherapy chamber, a steam inlet pipe is provided in the physiotherapy chamber on a bottom thereof to communicate with the steam pipe, and a steam flow guide plate is placed on a top of the steam inlet pipe with an annular space left between the steam flow guide plate and the inner surface of the physiotherapy chamber to allow the steam to flow upward via the annular space;

wherein the steam inlet pipe has two steam outlets that are horizontally extended in two diametrically opposite points close to the inner surface of the physiotherapy chamber around the bottom thereof, and the two steam outlets have open terminal ends directed to two opposite directions, such that the steam flowing out of the two steam outlets forms a swirl that overflows the steam flow guide plate via the annular space and moves upward along the inner surface of the physiotherapy chamber to thereby heat the tourmaline tiles provided thereon; and wherein the tourmaline tiles, after been heated, release far infrared rays that have the ability to permeate the user's skin, and negative ions that deeply enter the user's body with the help of the permeating ability of the far infrared rays; and both the far infrared rays and the negative ions reduce reactive oxygen species and free radicals in the user's body as well as help the user to give off deep-layer sweat.

2. The steam physiotherapy apparatus as claimed in claim 1, wherein the tourmaline tiles contain a type of natural pyroelectric mineral powder, which, when being heated, will release negative ions and far infrared rays.

3. The steam physiotherapy apparatus as claimed in claim 1, further comprising a top cover for removably closing the open top of the physiotherapy chamber, and the top cover being provided with a sideward opening.

4. The steam physiotherapy apparatus as claimed in claim 1, wherein the physiotherapy chamber is manufactured into an upper body portion and a lower body portion; and the door being provided on the upper body portion.

5. The steam physiotherapy apparatus as claimed in claim 4, further comprising a hoop, which is tightened around a joint between the upper and the lower body portion to simultaneously cover a lower edge of the upper body portion and an upper edge of the lower body portion, so as to prevent the upper and the lower body portion from moving laterally relative to each other.

6. The steam physiotherapy apparatus as claimed in claim 1, wherein the physiotherapy chamber is internally provided with a chair for the user to sit thereon.

7. The steam physiotherapy apparatus as claimed in claim 1, wherein the physiotherapy chamber has a peripheral wall, which defines a variable inner diameter gradually increasing from bottom to top, and the inner diameter at the open top of the physiotherapy chamber is reduced again to form a narrowed neck portion on the physiotherapy chamber.

8. The steam physiotherapy apparatus as claimed in claim 1, wherein the steam flowing out of the two steam outlets of the steam inlet pipe swirls counterclockwise.

* * * * *